United States Patent [19]

Ozawa et al.

[11] Patent Number: 4,520,764

[45] Date of Patent: Jun. 4, 1985

[54] STARTER FOR AN ALCOHOL ENGINE

[75] Inventors: Masuo Ozawa, Yokohama; Toshio Hirota, Yokosuka, both of Japan

[73] Assignee: Nissan Motor Co., Ltd., Yokohama, Japan

[21] Appl. No.: 205,448

[22] PCT Filed: Dec. 27, 1979

[86] PCT No.: PCT/JP79/00329

§ 371 Date: Aug. 28, 1980

§ 102(e) Date: Aug. 27, 1980

[87] PCT Pub. No.: WO80/01398

PCT Pub. Date: Jul. 10, 1980

[30] Foreign Application Priority Data

Dec. 28, 1978 [JP] Japan ..... 53-161047

[51] Int. Cl.[3] ..... F02M 27/02; F02M 31/08

[52] U.S. Cl. ..... 123/3; 123/180 R; 123/DIG. 12; 123/180 E

[58] Field of Search ..... 123/1 A, 3, 180 R, 180 AE, 123/180 E, 576, DIG. 12

[56] References Cited

U.S. PATENT DOCUMENTS

| | | | |
|---|---|---|---|
| 3,933,130 | 1/1976 | Csicsery | 123/3 |
| 3,963,000 | 6/1976 | Kosaka et al. | 123/3 |
| 3,986,350 | 10/1976 | Schmidt | 60/274 |
| 4,226,213 | 10/1980 | Bernauer | 123/3 X |
| 4,230,072 | 10/1980 | Noguchi et al. | 123/3 X |

OTHER PUBLICATIONS

*Combustion and Emission of Gaseous Fuel from Reformed Methanol in Automotive Engine,* Tokuichi Inagaki et al. pp. 1–13.

*Primary Examiner*—William A. Cuchlinski, Jr.
*Attorney, Agent, or Firm*—Schwartz, Jeffery, Schwaab, Mack, Blumenthal & Evans

[57] ABSTRACT

A starter for an alcohol engine, which incorporates a reformer containing catalyst heated by exhaust gas to thereby react fuel alcohol so as to produce reformed gas containing hydrogen and carbon monoxide as main components and to store the produced gas in the reformer. The reformed gas is supplied to a carburetor of the engine at its starting time to mix it with the main fuel alcohol to supply the mixture to a combustion chamber so as to facilitate easy ignition.

8 Claims, 2 Drawing Figures

STARTER FOR AN ALCOHOL ENGINE

TECHNICAL FIELD

The present invention relates to a starter for an engine using alcohol, such as methanol, ethanol or the like, as its fuel.

BACKGROUND ART

In the recent years, alcohol has been considered as a prospective substitute for gasoline as fuel for automotive vehicles. However, alcohol has a higher boiling point than gasoline, as for example 64.5° C. in methanol. Consequently, a problem has developed in starting an alcohol fueled engine.

Accordingly, several proposals for solving the starting problems have been suggested. One such proposal is to store gasoline as an auxiliary fuel besides the alcohol and to use the gasoline at the starting time and to switch to alcohol after a certain warm up driving time i.e. when the temperature rises up to an extent sufficient for easy evaporation of the alcohol. Another proposal is to evaporate the alcohol by warming up the manifold by an electric heating wire at the starting time.

However, the former proposal has the disadvantage that the auxiliary fuel should be carried separately from the gasoline and the latter proposal has the disadvantage that a longer time is required for starting.

DISCLOSURE OF INVENTION

In view of the aforementioned situation, the present invention has as its object to provide a starter for an alcohol engine which is able to start an alcohol engine as easily as a conventional gasoline engine.

In accordance with the above object, in the present invention, a part of the fuel alcohol is reformed into a gaseous fuel containing hydrogen and carbon monoxide as the main components during operation of the engine and is stored and thus stored gaseous fuel is supplied to the engine when starting the engine so as to obtain an easy ignition thereof.

The invention will now be explained by referring to the drawings.

BEST MODE OF CARRYING OUT THE INVENTION

Figure 1:
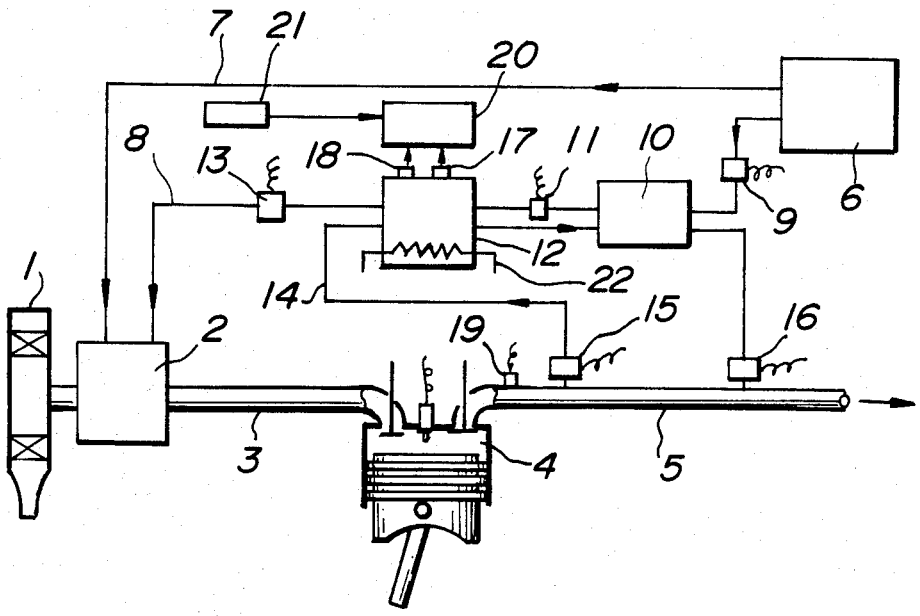
FIG. 1 is a diagrammatic illustration showing one embodiment of the present invention.

In FIG. 1, 1 is an air cleaner, 2 is a carburetor, 3 is an intake tube, 4 is a combustion chamber of the engine body, 5 is an exhaust tube, and 6 is a fuel tank for storing the fuel alcohol. The alcohol is supplied to the carburetor 2 via a main fuel passageway 7.

As the starter according to the present invention, a passageway 8 leading from the fuel tank 6 to the carburetor 2 is provided separately from the main fuel passageway 7. In this passageway 8, an electromagnetic valve 9, an evaporator 10, an electromagnetic valve 11, a reformer 12, and an electromagnetic valve 13 are inserted in the above order starting from the fuel tank side. A passageway 14 branched from the exhaust tube 5 at comparatively upstream point thereof is provided via an insertion of an electromagnetic valve 15. Passageway 14 extends to the reformer 12 and to the evaporator

10 in such a manner that these components are supplied with heat from the exhaust gas. This passageway 14 is thereafter connected at relatively downstream position of the exhaust tube 5 via an intervention of an electromagnetic valve 16. The aforementioned reformer 12 has a catalyst bed which is filled up with a reforming catalyst at the inside.

17 and 18 are sensors for detecting the pressure and the temperature, respectively, in the reformer 12, 19 is a sensor for exhaust gas temperature, and 20 is a control unit operating by signals sent from these sensors 17, 18 and 19 and a signal sent from a starter switch 21 and for controlling the electromagnetic valves 9, 11, 13, 15 and 16.

This control unit 20 acts to open the electromagnetic valves 9, 11, 15 and 16 when the pressure in the reformer 12 detected by the pressure sensor 17 is lower than a previously settled value (this settled value is compensated by a temperature detecting signal sent from the temperature sensor 18) and also when the exhaust gas temperature detected by an exhaust gas temperature sensor 19 is higher than a previously settled value and it also acts to open the electromagnetic valve 13 when the starter switch 21 is turned on.

The operation of the device of the present invention will be explained hereinafter.

During the operation of the engine, if the pressure of the reformed gas in the reformer 12, which has been produced and stored therein in a manner described hereinafter, is lower than the previously settled value, namely if the residual amount of the reformed gas is not sufficient, the electromagnetic valves 9, 11, 15 and 16 are opened provided that the exhaust gas temperature is higher than the previously settled value, namely when the exhaust gas temperature is high enough for the formation of the reformed gas, then the alcohol delivered from the fuel tank 6 to the reformer 12 via the evaporator 10 reacts on the catalyst bed (in case of methanol; $CH_3OH \rightarrow 2H_2 + CO$) and the reformed gas containing hydrogen and carbon monoxide as the main components is produced. Herein, this reaction is an endothermic reaction and the reaction heat is obtained from the exhaust gas passing through the passageway 14. The produced reformed gas is adsorbed in the reforming catalyst in the reformer 12 since the electromagnetic valve 13 is then closed. If the pressure in the reformer 12 rises by this, the electromagnetic valves 9, 11, 15, and 16 are closed again to discontinue further production of the reformed gas and the already produced reformed gas remains stored in the reformer 12.

At restarting of the engine after it had been stopped, the starter switch 21 is operated to be in the ON condition, and by this the electromagnetic valve 13 is opened, and as has been explained in the foregoing, the stored reformed gas in the reformer 12 being rich in hydrogen and carbon monoxide is supplied to the carburetor 2 and this reformed gas is mixed with the air and with alcohol fed through the main fuel passageway 7 in the carburetor 2 and is fed to the combustion chamber 4. This reformed gas has very excellent combustion characteristics of a high combustion speed, and of small ignition energy. Accordingly, the engine can be started very easily.

Once the engine is started, it can be driven only by alcohol so that the electromagnetic valve 13 is closed again simultaneously with the turn off of the starter switch 21 and the supply of the reformed gas is discontinued.

After the supply of the reformed gas, if there still remains a sufficient reformed gas in the reformer 12, the formation of the reformed gas is not effected even if the exhaust gas temperature is high, however, if there is not much reformed gas remaining therein, the electromagnetic valves 9, 11, 15 and 16 are kept opened at rising of the exhaust gas temperature and the reformed gas is produced and stored in the same manner as has been explained in the foregoing to prepare for the next starting.

In case sufficient heat for the reformation reaction is not obtained from the heat of the exhaust gas, an electric heating wire 22 is embedded in the reformer 12 and an electric current is supplied substantially synchronized with the opening of the electromagnetic valves 9, 11, 15 and 16 and the necessary heat for the reformation reaction may be produced for a part or all by this electric heat.

Furthermore, the reformer 12 may be one incorporating evaporator 10 and in this case the electromagnetic valve 11 can be dispensed with.

Figure 2:
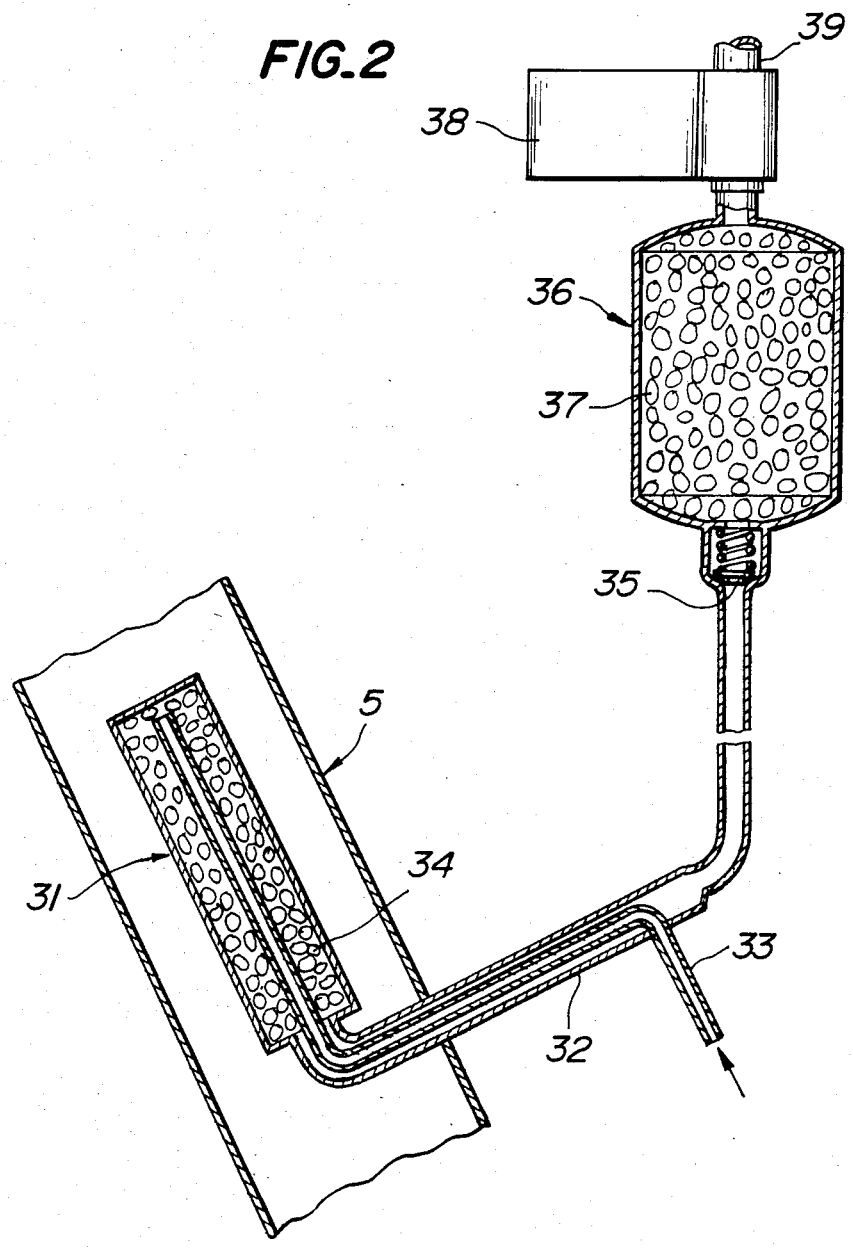
FIG. 2 is a cross-sectional view showing an essential part of a modified embodiment thereof.

FIG. 2 shows an embodiment in which the reformer for reforming alcohol into gas and a storage device for storing the reformed gas are provided separately.

Namely, a cylindrical shaped reformer 31 is arranged in the exhaust gas pipe 5 and a cooling tube 32 penetrating the exhaust gas pipe 5 and connected at one end of the reformer 31 is arranged outside the exhaust gas pipe 5. A supply conduit 33 of alcohol is introduced in the cooling tube 32 at middle point thereof and extended coaxially therein and also coaxially in the reformer 31 to form double tube construction and an end thereof is opened adjacent another end of the reformer 31. Inside the reformer 31, the reforming catalyst is filled up.

The aforementioned cooling tube 32 is connected via a non-return valve 35 to a lower end portion of a gas storage device 36 formed cylindrically, which is filled up with adsorbing member 37 such as activated carbon, alumina, metal hydride or the like. An upper end of the gas storage device 36, a normally closing valve 38 (acting in the same manner with the aforementioned electromagnetic valve 13) is mounted. 39 is a gas outlet.

The operation is now explained. During operation of the engine, alcohol is supplied via the alcohol supply conduit 33 into the reformer 31 and is evaporated in the conduit 33 by a heat exchange with the reformed gas passing through the cooling tube 32 for instance, and this alcohol is reformed into gas such as hydrogen and carbon monoxide or the like in the reformer 31 by the reforming catalyst 34 while taking the heat of the exhaust gas flowing through the exhaust tube 5. The reformed gas passes through the cooling tube 32 and is cooled by the heat exchange with the alcohol flowing through the supply conduit 33 prior to its reaction and enters into the gas storage device 36 via the non-return valve 35 and stored therein by adsorption of the adsorbing member 37. The gas storage device 36 may be a mere hollow bomb without the adsorbing member 37 but the storage efficiency can be much improved by filling up the adsorbing member 37.

After stopping the engine, even if the pressure in the reformer 31 decreases, the reformed gas remains stored in the storage device 36 since the non-return valve 35 is provided at entrance of the storage device 36. At starting of the engine, the control valve 38 is opened and the gas stored in the gas storage device 36 is supplied to the carburetor of the engine through the gas outlet 39 and via a tubing system not shown in the drawing.

By providing the reformer and the gas storage device separately as explained above, the following advantage can be obtained. Firstly, since the reformer is exposed to the exhaust gas of the engine, it may be heated up to 300° to 700° C. during operation of the engine so that if the gas is stored in such a high temperature reformer, it is inevitable that the amount of storage decreases. However, if the gas storage device is provided separately, the amount of storage can substantially be increased since the gas can be stored at a lower temperature. Secondly, if the gas is stored in the reformer, the temperature variation between the operation of the engine and non-operation of the same after stopping is considerably large so that the gas pressure decreases at low temperature after the stopping of the engine so that a sufficient amount required for the starting may not be supplied. However, the pressure of the storage gas is not so lowered when the gas is stored at lower temperature from the beginning by arranging the gas storage device separately. Thirdly, the reformer can be made small and it can be arranged in the exhaust gas pipe so that it is possible that the recirculation efficiency of the heat of the exhaust gas can be increased.

The necessary amount of the reformed gas required for one starting is very small and it is about 1 l in an engine having displacement of 2 l. Therefore, if we intend to store 3 l of gas for considering some more spare amount, the size of the storage device filled with adosrbing member may be in an order of about 40 mm in the diameter and 80 mm in the length. The size of the reformer may be about 25 mm in the diameter and 60 mm in the length and it may easily be accommodated in the exhaust gas tube.

INDUSTRIAL APPLICABILITY

As has been explained in the foregoing, according to the present invention, there is no need to mount an auxiliary fuel for starting besides the fuel alcohol and the reformed alcohol gas is excellent in the combustion characteristics such as small ignition energy so that starting is very easy. Therefore the present invention contributes in saving the fuel petroleum resources.

We claim:

1. In combination, an alcohol engine which operates exclusively on alcohol fuel, a source of alcohol fuel connected to said engine, and a starter for said engine, said starter comprising:

means connected to said fuel source for receiving alcohol fuel from said fuel source and reforming a portion of said alcohol fuel during operation of said engine into gaseous fuel containing hydrogen and carbon monoxide as its main components, comprising reforming means for producing said gaseous fuel, and storage means for storing said gaseous fuel, and wherein said reforming means is positioned to receive heat from an exhaust pipe, and said storage means is located in a position remote from said engine and said exhaust pipe so as not to be affected by heat from said engine or said exhaust pipe; and means for supplying said gaseous fuel to said engine from said storage means only during starting periods of said engine.

2. The combination as set forth in claim 1, wherein said storage means contains an adsorbing material for adsorbing said gaseous fuel.

3. The combination as set forth in claim 1, wherein said combination includes an engine starting switch, and said supplying means is connected to said switch and responsive to actuation of said switch for supplying said gaseous fuel to said engine.

4. The combination as set forth in claim 3, wherein said reforming means is located within said exhaust pipe.

5. A starter for an alcohol engine using alcohol exclusively as its fuel, comprising in combination:

an evaporator for evaporating said fuel alcohol into a gaseous phase;

a reformer for reforming the evaporated fuel alcohol into gaseous fuel, which fuel contains hydrogen and carbon monoxide, said reformer containing a reforming catalyst as the main reforming element;

an adsorbing member for storing the generated reformed gaseous fuel; and a control unit for controlling supply of the fuel alcohol into the reformer through the evaporator by detecting temperature and pressure of the gaseous fuel in the reformer and controlling feed of the reformed gaseous fuel.

6. A starter for an alcohol engine as claimed in claim 5, wherein the evaporator and the reformer are built in a unitary container.

7. A starter for an alcohol engine as claimed in claim 5 or 6, wherein the reformer contains said adsorbing member to act as a storage device for storing the reformed gaseous fuel.

8. A starter for an alcohol engine as claimed in claim 5 and further including electric heating means for heating said catalyst, and wherein the control unit supplies an electric current to said heating means to heat the catalyst to make it active.

* * * * *